299-13 SR

4/5/83 XR 4,378,949

United States Patent [19]

Miller

[11] 4,378,949

[45] Apr. 5, 1983

[54] PRODUCTION OF SHALE OIL BY IN-SITU RETORTING OF OIL SHALE

[75] Inventor: J. Blaine Miller, Englewood, Colo.

[73] Assignee: Gulf Oil Corporation, Pittsburgh, Pa.

[21] Appl. No.: 257,626

[22] Filed: Apr. 27, 1981

Related U.S. Application Data

[63] Continuation-in-part of Ser. No. 59,321, Jul. 20, 1979, abandoned.

[51] Int. Cl.[3] ..... E21C 41/10

[52] U.S. Cl. ..... 299/2; 299/13

[58] Field of Search ..... 299/2, 13, 19, 11; 166/259, 260

[56] References Cited

U.S. PATENT DOCUMENTS

| | | | |
|---|---|---|---|
| 3,001,776 | 9/1961 | van Poollen | 299/2 |
| 3,342,257 | 9/1967 | Jacobs et al. | 166/259 |
| 3,434,757 | 3/1969 | Prats | 299/2 |
| 3,460,867 | 8/1969 | Cameron | 299/2 |
| 3,586,377 | 6/1971 | Ellington | 299/2 |
| 3,661,423 | 5/1972 | Garrett | 299/2 |
| 3,999,607 | 12/1976 | Pennington | 166/260 |
| 4,017,119 | 4/1977 | Lewis | 299/2 |
| 4,022,511 | 5/1977 | French | 299/2 |
| 4,140,343 | 2/1979 | Mills | 299/2 |
| 4,185,871 | 1/1980 | Krapil | 299/2 |

*Primary Examiner*—William F. Pate, III

*Attorney, Agent, or Firm*—Deane E. Keith; Forrest D. Stine; Paul L. Tillson

[57] ABSTRACT

A modified in-situ retort for the retorting of oil shale is constructed by mining an open space having a volume of twenty-five to thirty-five percent of the volume of the retort in the bottom of the retort and thereafter blasting the oil shale that is to remain in the retort as rubble in a manner to cause random free fall of the shale particles onto the rubblized bed. Blasting occurs sequentially from the bottom of the unfragmented shale immediately above the open space to the top of the retort. At each blast, there is an open space below the shale to be broken in the blast having a volume at least one-third the volume of that shale, and the timing of the blasts is such that movement of the broken shale is not interfered with by shale broken in the preceding blast. There is no withdrawal of oil shale that would cause downward movement of the rubble that is to be retorted in-situ. The resultant in-situ retort is characterized by a high and uniform permeability.

18 Claims, 7 Drawing Figures

PRODUCTION OF SHALE OIL BY IN-SITU RETORTING OF OIL SHALE

This application is a continuation-in-part of my U.S. application Ser. No. 59,321, filed July 20, 1979 abandoned.

BACKGROUND OF THE INVENTION

1. Field of the Invention

This invention relates to the production of shale oil and more particularly to the construction of an in-situ retort and production of shale oil from such retort.

2. Description of the Prior Art

A method of retorting oil shale that has been proposed as particularly advantageous for recovery of shale oil from oil shale deposits covered by an overburden of substantial thickness is in-situ retorting of the oil shale. In that process, an in-situ retort is formed by blasting oil shale to break it into rubble that fills the in-situ retort. Retorting is accomplished by heating the rubblized oil shale to a temperature, generally above 800° F., at which kerogen in the oil shale is converted to shale oil. Heat for the retorting is provided by heating a portion of the oil shale in the retort to an ignition temperature and passing air through the heated portion of the oil shale to continue combustion of carbonaceous material in the oil shale. Gaseous combustion products travel through the in-situ retort to its outlet and in doing so heat oil shale ahead of the combustion front to a temperature at which conversion of the kerogen to the shale oil occurs. The liberated shale oil is delivered to the surface by any suitable means.

Rubblization of the oil shale to form an in-situ retort is necessary because oil shale has a very low permeability which precludes forcing retorting gases through the oil shale at a rate adequate to maintain a combustion front. Rubblization is accomplished by removing by any desired mining method a portion of the oil shale to provide open space and thereafter blasting shale adjacent the open space space to break it into particles to fill the open space. While the open space required for rubblization has been described as less than forty percent of the retort volume, in fact, the open space actually used is substantially less. For example, in U.S. Pat. No. 4,043,597 of French, it is stated that the total volume of the voids should be less than about 40 percent of the volume of the retort; however, that patent states that the void space should be less than 20 percent and is preferably about 15 percent of the volume of the retort. (Throughout the specification and claims the term "open" space designates space devoid of shale outside the boundaries of the rubblized shale, and the term "void" space designates space between shale particles within the rubblized mass.) In U.S. Pat. No. 3,661,423 of Garrett, it is stated that the void space may be 5 to 25 percent of the volume of the retort but is preferably 5 to 15 percent of the retort volume. French describes the pieces of rubblized shale as being wedged together tightly. Garrett describes the rubblized shale as being packed. It has been recommended heretofore that the void space be as low as possible to minimize the amount of mining of oil shale necessary to provide void space.

In the rubblization procedures heretofore described, the amount of open space provided is such that the retort will be filled at the completion of the rubblization and is adequate only to permit enough movement of shale pieces relative to one another to result in fragmentation rather than merely fracturing of the oil shale. By fracturing is meant merely forming a crack in the formation; fragmentation means forming a plurality of interconnecting fractures that break the shale into a plurality of particles. The movement that occurs on the blasting in the methods heretofore used is limited by adjacent pieces of the oil shale so that the movement is essentially a slight moving apart of the pieces of shale with only enough displacement of the pieces of shale to prevent mating as the pieces of shale come to rest after the blasting. In fact, open space permitting the desired fragmentation is derived in the processes heretofore available in part from compressing, wedging or jamming previously rubblized material into a more tightly packed condition. The permeability of such rubblized structures although lower than desirable is adequate to allow some flow of gases through the retort but uniform permeability throughout the retort is not obtained. Because of the nonuniformity of the permeability, channeling of fluids through the retort during in-situ combustion occurs with resultant bypassing of portions of the oil shale and lower yields of shale oil. Moreover, while the permeability is adequate to allow combustion to proceed, the relatively low permeability results in high pressure drop through the retort during the retorting and high costs for circulation of combustion air and retort gases.

In an effort to improve the uniformity of the permeability in the retort, rather elaborate and expensive steps have been taken during the rubblization. For example, in U.S. Pat. No. 4,043,598 of French, an open space is formed at vertical intervals of about 195 feet and unfragmented shale between the open spaces is blasted into the open space. At each open space, it is necessary to construct withdrawal drifts communicating with apparatus for lifting the mined oil shale to the surface. In a retort 1,000 feet high having five intervals of approximately 200 feet, it would be necessary to provide rock handling facilities at five levels with consequent very high mining costs. In spite of the steps taken in an attempt to improve the uniformity of the permeability of a retort, substantial channeling and bypassing still occur.

SUMMARY OF THE INVENTION

This invention resides in a novel method of constructing an in-situ retort containing rubblized oil shale particles that results in a retort having a high and exceptionally uniform permeability. The rubblized oil shale particles are positioned in the retort in a random free-fall arrangement, such as occurs in dropping solid particles into a bin, by blasting the oil shale in a manner which permits rotation and displacement of the pieces relative to one another during the blasting and before being deposited in the rubblized mass. To obtain the random free-fall arrangement, an open space of 25 to 40 percent of the entire volume of the retort is formed in the lower portion of the desired retort before rubblization of shale that is to remain in the retort other than small amounts that may be left during the mining of the open space for convenience, safety, or to expedite the mining. Oil shale overlying the open space is broken in a series of blasts in which the volume of the open space at each detonation is at least one-third the volume of shale that will be broken loose from unfragmented shale in the blast. The time between successive blasts is long enough that movement of shale broken loose in a blast will not be restricted or interfered with by pieces of shale broken loose in the immediately preceding blast. The resultant rubblized mass has a void space of 25 to 40 percent and is characterized by a permeability that is not only higher, but much more uniform than is obtained in prior art rubblizing processes. In a preferred embodiment, the upper end of the retort is arched and the rubblization does not result in complete filling to the top of the arch, thereby leaving an attic free of rubblized pieces of shale at the top of the retort.

DESCRIPTION OF PREFERRED EMBODIMENT

Figure 1:
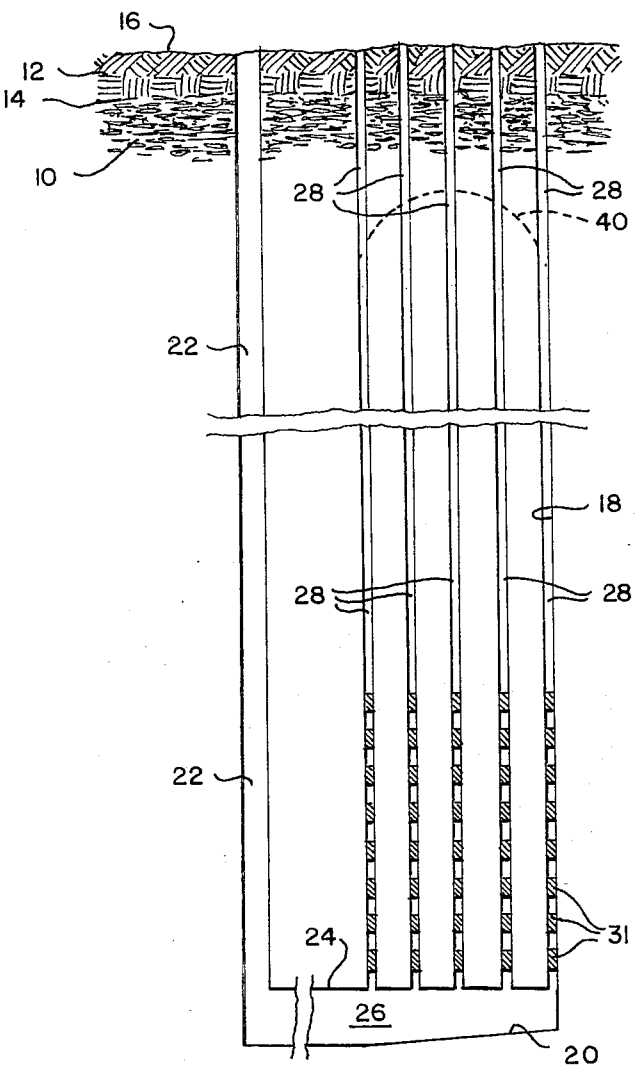
FIG. 1 is a diagrammatic vertical sectional view of a retort during the initial stage of mining an open space in the lower end of the retort.

Referring to FIG. 1, an oil shale deposit 10 is shown underlying overburden 12 which extends from the top 14 of the oil shale deposit to the ground surface 16. The desired retort 18 is shown in broken lines in FIG. 1. The lower end 20 of the retort 18 may be in the shale deposit 10, or as will be described with reference to the embodiment illustrated in FIG. 7, in a rock formation below the shale deposit. A shaft 22 is sunk from the ground surface 16 to the desired level of the lower end of the retort 18 and an exhaust drift 24 driven from the lower end of the shaft to the retort 18.

A room 26 having a horizontal cross section that conforms to the horizontal cross section of the desired retort 18 is mined at the lower end 20 of retort 18. The oil shale mined in the construction of room 26 is withdrawn through drift 24 and lifted through shaft 22 to the surface for surface retorting. Mining of room 26 is the first stage of developing the open space necessary to provide the rubblized mass of desired void space of oil shale in the in-situ retort. Room 26 is formed by conventional mining procedures. Its height only need be such as to allow mining machinery to work in the excavated space and allow rubble draw. The room should have a width of 30 to 150 feet and preferably from 50 to 100 feet such that the roof of the completed retort will be self-supporting. The length of the room will be the length of the desired retort. Since the side walls provide the support for the roof, limitation on the length is determined by the maximum size of retort that is desired. Because there may be reason to abandon a retort before all of the shale therein is retorted, retorts are limited in length to reduce the loss that would occur upon abandonment. It is contemplated that the length of the retorts will ordinarily be in the range of 60 to 400 feet, but the length of the retort is not limited by this invention. The roof of the room 26 may, but will ordinarily not, be arched to increase its strength as will the roof of the retort.

A plurality of shot holes 28 are drilled, preferably from the ground surface, to the lower end of the desired retort. The shot holes may be drilled before or after mining of room 26. Alternatively, the shot holes can be drilled upwardly from room 26 or downwardly from a subsurface room mined above the desired retort and separated from the retort by a suitable sill. If drilled before room 26 is mined, the shot holes can be used to facilitate ventilation during the mining of the room 26.

Shot holes 28 are located in a laterally spaced-apart arrangement designed to provide effective and uniform rubblization over the entire cross-sectional area of the retort. It is desirable that the pieces of oil shale in the rubble to be retorted have a maximum dimension of 2 to 10 inches. The shot holes will be spaced apart a lateral distance of, for example, 10 to 35 feet. The spacing of the shot holes will depend upon the size of the shot hole, the size of the explosive charge that will be detonated, the characteristics of the oil shale, and the location of the particular shot hole in the room. Typically, the shot holes can be approximately 6 to 12 inches in diameter such as may be drilled with conventional drill bits.

Figure 5:
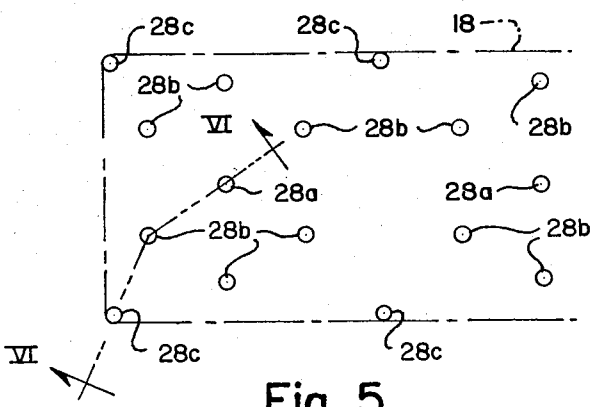
FIG. 5 is a plan view showing a pattern of shot holes in the retort.

Referring to FIG. 5, an arrangement of shot holes is shown with a plurality of shot holes **28*a* located along the center line that extends longitudinally of the retort. Spaced around the shot holes 28*a* are shot holes 28*b* in an inner ring and shot holes 28*c* in an outer ring along the boundaries of the room 26. The arrangement shown in FIG. 5 is shown as an example of an arrangement that can be used in one particular retort. The arrangement used will depend upon the dimensions of the desired retort, the characteristics of the oil shale, and the design of the blasting operation with respect to the size and type of explosive charge used. The pattern of arrangement of the shot holes is for optimization of rubblization, not the creation of the open space necessary for rubblization; however, the shot holes 28** can advantageously be used in mining the shale to provide open space for the subsequent rubblization.

Figure 3:
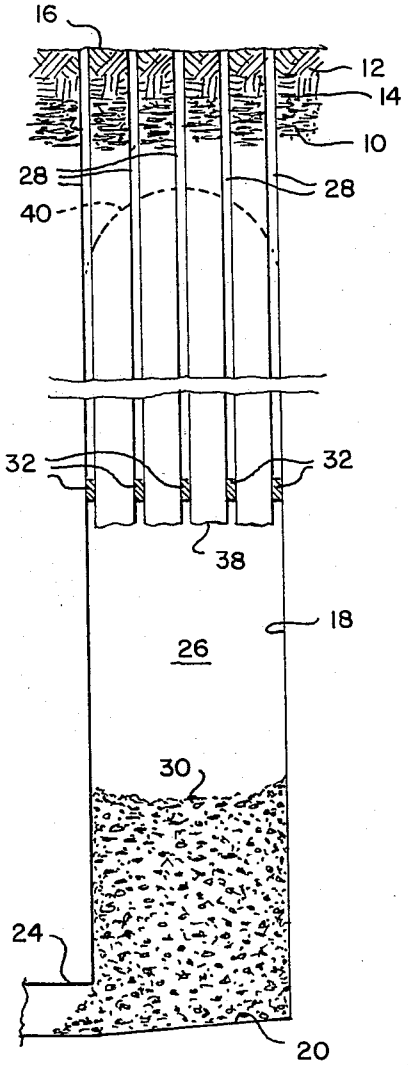
FIG. 3 is a diagrammatic vertical sectional view of the retort at an intermediate stage of rubblization.
Figure 2:
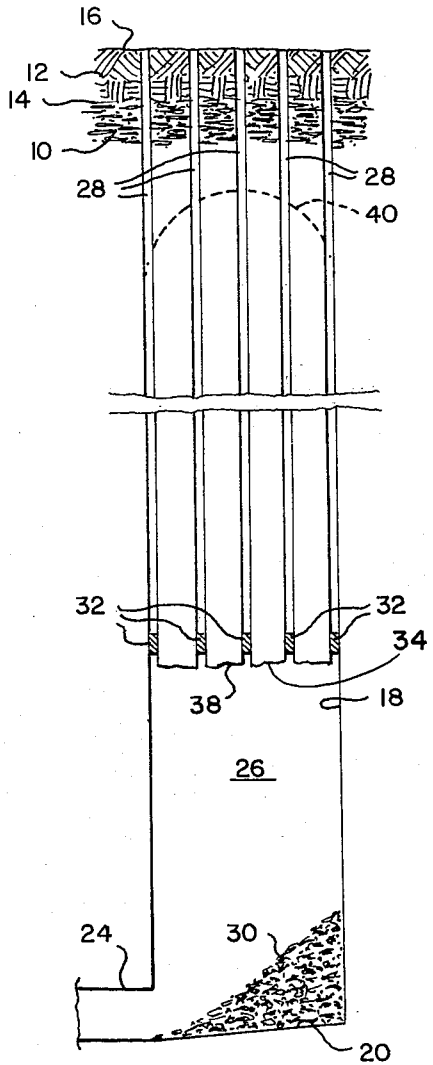
FIG. 2 is a diagrammatic vertical sectional view of the retort at completion of the formation of the open space.

Extension of the open space upwardly is accomplished by detonating explosive charges at successively higher levels in the shot holes 28 to break shale overlying room 26. The shale falls to the floor 20 of room 26 and is removed therefrom through drift 24 by mucking equipment. The mucking equipment may be able to reach from the drift 24 only a part of the way across the retort 18. If so, to avoid the necessity of miners entering the room 26 during the mining of the open space, a pile 30 of broken oil shale may be left along the side of the retort remote from the drift 24. While that shale is broken by the blasting, its presence is incidental to the creation of the open space, not the rubblization. The mining and blasting operation used in extending room 26 upwardly, as shown in FIG. 2, is not critical as the broken shale will not be retorted in-situ. It is only necessary that the pieces of shale be of a size that can be handled readily, removed through drift 24, and lifted to the surface through shaft 22.

The mining of room 26 can be accomplished by any desired mining method. It is only necessary to form room 26 extending upwardly high enough to provide the open space required for the subsequent rubblization of the oil shale that will be left in the in-situ retort for retorting. The upward extension of room 26 must be high enough to provide void space for rubblization of the entire amount of the shale that will be in the completed retort. In that way, downward movement of the bed of rubblized shale, and the consequent compaction inherent in such movement, is avoided. In the particular method of mining described with reference to the drawings, a plurality of explosive charges 31 are placed at vertically spaced intervals in the shot holes 28 and detonated in series from the bottom up to a level that will extend room 26 upwardly to the level 34 shown in FIG. 2 of the drawings. The location of level 34 is such that the volume of the open space below level 34 is 25 to 40 percent, and preferably 30 to 35 percent, of the volume of the completed retort. If the retort is to have a height of 1,000 feet, for example, level 34 will be at least 250 feet above floor 20. In the mining of room 26, muck can be cleared from the room 26 after blasting of each level of charges 31 or after all of the charges have been detonated. Compaction of the muck by downward movement is not harmful as that material is lifted to the surface and ground to a size suitable for surface retorting.

The open space of 25 to 40 percent, preferably 30 to 35 percent, of the retort volume is adequate to allow random fill of the retort with rubblized oil shale. The term "random fill" is used to designate the type of fill that occurs when, for example, a stream of solid particles tumbling down a chute falls freely through space into a bin. Such random fill usually has a void space of 25 to 40 percent. In some formations, for example, the oil shale may break into pieces of tabular form. In such formations, the void space in the random fill may be as low as 25 percent. In random fill, the pieces of shale essentially rest on one another and are not packed or wedged and jammed as is inherent and necessary in a rubblized mass having a void space less than 25 percent.

It is important to rubblization to provide the random-fill rubble mass desired that removal of the shale necessary to provide the void space for the entire retort is accomplished before rubblization of oil shale begins to avoid movement of the oil shale after it has been deposited in the mass of rubble. If there is alternate shooting and removal of oil shale to provide open space for subsequent rubblizing of shale, the resultant downward movement of the rubblized shale results in some grinding, shifting and packing of the shale with reduction in the void space and the permeability of the rubblized shale.

In addition to providing adequate open space for random fill of the entire retort, it is necessary that there be adequate open space at each detonation and adequate time between successive detonations for the broken particles to move substantially independently of broken adjacent pieces of shale as they are broken from the unbroken shale and fall into the rubble. Such movement of the pieces of shale is designated herein as "random free fall" of the pieces of shale. Thus, at each detonation, there should be open space located adjacent the unbroken shale through which the resultant broken pieces of shale fall to permit rotation and displacement of the shale pieces to give a random fill. At each detonation the open space above the rubblized mass should be at least one-third as large as the slice of shale broken by the detonation. Open space within the mass of rubblized shale is of no value in random fill of shale pieces broken in a subsequent detonation. Random free fall can occur only in open space overlying the rubble. A process in which a relatively large mass of shale is fractured and there is only enough movement of shale pieces relative to adjacent pieces to prevent mating of the adjacent pieces with resultant closing of the fractures will not accomplish the desired random fill of the retort.

The open space into which the shale broken falls of at least one-third the volume of the shale broken is adequate only if the rubblized shale has a void space that does not exceed 25 percent and no attic above the rubble is desired. a percentage void space that is typical of a random free fall filled rubblized shale mass, the open space into which the shale is blasted must be at least 43 percent of the unfragmented volume of the shale broken at each detonation. The open space mined before rubblization of the shale that is to be left in the retort becomes particularly critical as rubblization reaches the top of the retort. For example, if the open space provided is only 25 percent of the volume of the retort and the rubble produced should have a void space of 30 percent, there would be no more open space after about 78 percent of the shale to be left in the retort had been rubblized. Blasting of the top portion of shale would result in a tightly packed mass with extremely low void space in the top portion of the rubblized mass.

To accomplish the random filling of the retort with rubblized shale, explosives in an amount and character adapted to break up a slice of shale forming the roof of the open space are placed in the shot holes 28. The slice will ordinarily be approximately 20 feet thick or more but may be thinner. For example, explosive charges in the order of one-half the thickness of the shale slices several feet long to be broken may be loaded into the shot holes at a depth preferably determined by experimentation to break a slice of such thickness. Any explosive can be used that will shatter the oil shale into particles of the desired size distribution. ANFO is a preferred explosive, use conditions permitting. The essential criterion is that the blasting to break off a slice of the shale immediately above the open space be accomplished in a manner to permit sufficient movement of the pieces of shale relative to one another that random fill occurs.

In one program illustrated in FIG. 5 of detonation of explosives for rubblization, the explosive charges in shot holes 28 at the same elevation in the retort are detonated successively proceeding from an initial detonation in shot holes **28*a* and proceeding radially outward to shot holes 28*b* and then shot holes 28*c*. In this manner, the free face area toward which the shale is blasted by each shot is increased for the explosive charges other than those in the shot holes 28*a***.

Figure 6:
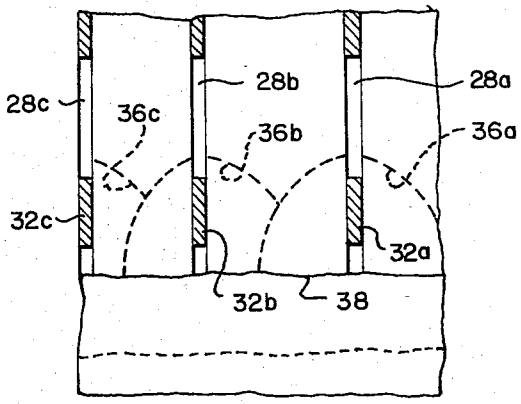
FIG. 6 is a vertical sectional view indicating diagrammatically one pattern of blasting to rubblize the shale.

Referring to FIG. 6, the detonation of the explosive charge **32*a* in shot hole 28*a* will break loose a cone-shaped segment of the shale such as is indicated by broken line 36*a*. Then when explosive charge 32*b* in shot hole 28*b* is detonated, the shale surrounding shot hole 28*b* will be blasted towards the lower face 38 of unfragmented shale and the free face defined by broken line 36*a*. Similarly, when explosive charge 32*c* is detonated, shale surrounding the charge will be blasted toward the free face 38 and the free face indicated by broken line 36*b***.

In programming the detonation of the explosive charges, time should be given for particles from one detonation to move sufficiently that they will not interfere or restrict movement of particles from a second detonation. For example, explosive charge **32*b* may be detonated from 5 to 100 milliseconds and preferably about 25 milliseconds after charge 32*a* is detonated. Similarly, charge 32*c* should be detonated approximately 5 to 100 milliseconds and preferably about 25 milliseconds after charge 32*b*** is detonated. The times specified are times consistent with rapid construction of the in-situ retort and are times adequate to permit oil shale pieces broken by one detonation from interfering with the movement of oil shale pieces broken by the next detonation. Longer periods between the detonation of explosive charges at the same level in the retort can be used if desired.

Ordinarily it will be desirable to delay blasting at the next higher level of explosive charges to permit inspection of the rubblized mass before blasting to break up the next higher level of oil shale. If revisions of the blasting appear to be desirable, suitable changes such as in the size of the explosive can be made. Moreover, damage to an explosive charge in a shot hole by pressure from detonating a charge lower in the shot hole can be avoided by loading the explosive charges at one level in the shot holes after blasting at the next lower level.

If it should be desired to blast the entire depth of the retort above room 26 in a single continuous series of blasts, it is preferred that the explosive charges at the next higher level in the shot holes be detonated approximately 100 milliseconds after the adjacent lower explosive charge in each shot hole; however, that time also is not critical and may be much longer if it is desired to characterize the rubble between shots. A period of about 50 milliseconds is adequate to move the shale particles broken at one level a distance such that their movement will not be interfered with by particles from the later detonation at the next higher level as long as there is adequate room for the particles to continue movement during the 50 millisecond period.

Another method of rubblizing the shale is to detonate all of the explosives at the same elevation in the shot holes 28 substantially simultaneously followed by detonation of the explosive charges at the next higher level. The procedure is repeated at successively higher levels until the retort is extended upward for the desired height. The time between detonations at adjacent levels is adequate, for example at least 50 milliseconds, to avoid interference of movement of shale blasted in one slice by particles of shale blasted in the next preceding or succeeding slice. At each level a thin slice of shale is broken from the lower end of the unfragmented shale immediately above the open space above the rubblized shale. The open space is at least one-third the volume of shale broken in each slice to provide a random-filled rubblized mass.

Figure 7:
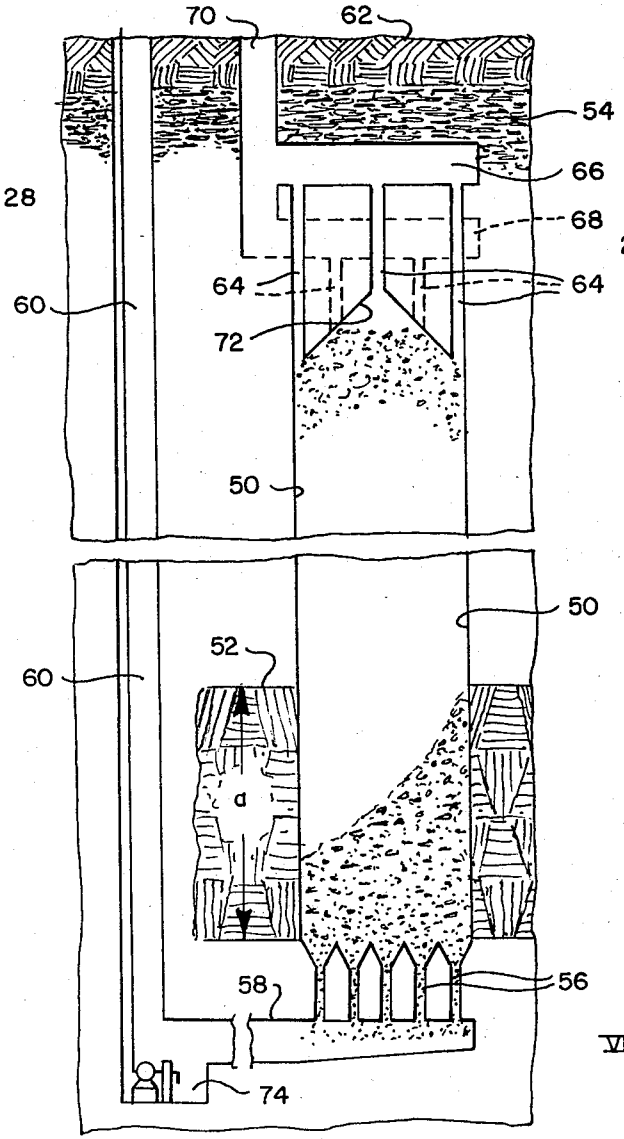
FIG. 7 is a diagrammatic vertical sectional view of a second embodiment of the invention.
Figure 4:
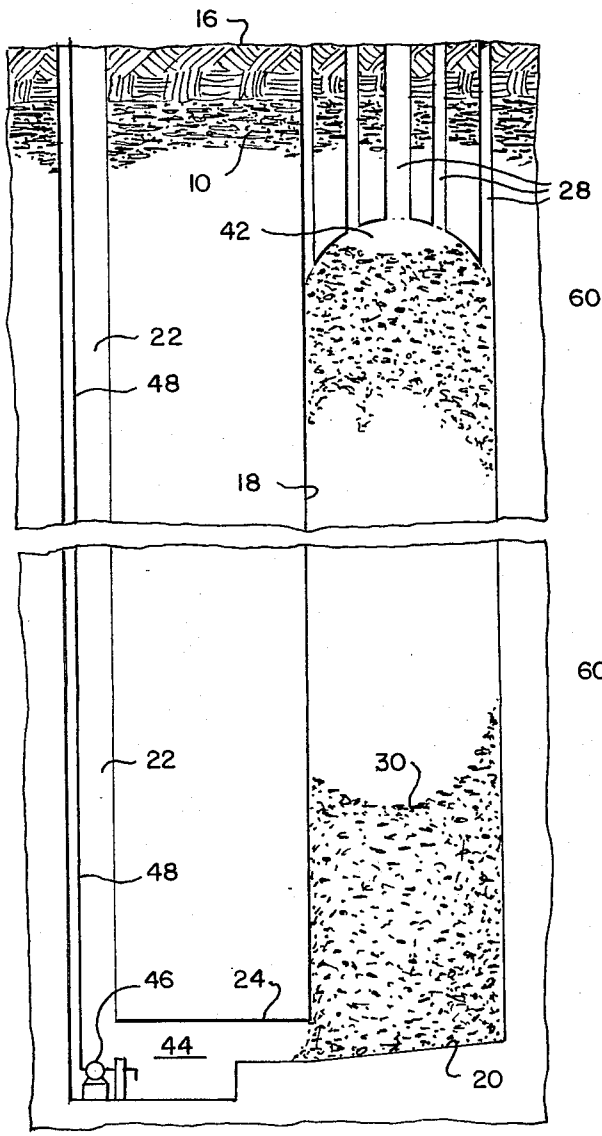
FIG. 4 is a diagrammatic vertical sectional view of a completed retort.

The explosive charges 32 adjacent the roof 40 of the retort preferably are positioned and designed to provide a retort with an arched roof as is best illustrated in FIG. 4. The term "arched roof" is used herein to designate a roof in which the roof at its intersection with the side walls is at an angle at least of 45 degrees with the horizontal. The roof may be as illustrated in FIG. 4 or a flat sloping roof as illustrated in FIG. 7. Because of the large open space provided for the rubblization, it is contemplated that the rubble will not completely fill the retorts and will leave an empty attic 42 at the upper end of the retort.

Either before rubblization of the retort or after rubblization has been completed, some of the shot holes 28 may be reamed as shown in FIG. 4 to increase their diameter whereby the shot holes may provide ducts for supplying combustion air and steam during the retorting operation. A sump separator 44 is constructed in drift 24 to separate gas and catch liquids produced during the retorting operation. Suitable means such as a pump 46 and liquid product line 48 are provided to lift liquid products from the sump to the surface. Combustion product gas is brought to the surface via a conduit not shown in shaft 22.

Any of the usual operating procedures for the in-situ retorting of oil shale can be used in the retort produced as herein described. Several retorting procedures are described in U.S. Pat. No. 3,001,776 of Van Poollen. The preferred retorting operation is a downward flow operation performed by causing a hot gas to flow downwardly through the rubble to heat the oil shale to a temperature high enough to convert kerogen to shale oil. Steam or hot combustion gases could be injected into the upper end of the retort to accomplish such retorting. The preferred process is an in-situ combustion process. Combustion air and a fuel are injected into the upper end of the formation and the fuel ignited to heat the oil shale. When the oil shale at the upper end of the retort has been heated to a temperature high enough to initiate combustion of carbonaceous material in the oil shale, the flow of fuel is stopped and the flow of combustion air continued. Carbonaceous material left on the oil shale particles as the kerogen is converted to shale oil burns when contacted by the injected air. The resultant combustion front moves downwardly through the retort as injection of combustion air continues. Combustion products from the combustion front travel downwardly ahead of the combustion front to convert kerogen in shale below the combustion front to shale oil. The shale oil and combustion products flow out of the bottom end of the retort into drift 24. Liquids are caught in the sump 44 and pumped to the surface and the gaseous products are delivered to the surface through a conduit within shaft 22.

A retort was constructed in accordance with this invention in Rio Blanco County, Colorado. The retort was thirty feet long, thirty feet wide, and 160 feet high. Oil shale was mined from the lower portion of the retort and lifted to the surface to provide open space for rubblization. Rubblization was accomplished by detonation of explosives in shot holes at each of the corners, substantially the midpoint of each side, and three in central positions within the retort, making a total of eleven shot holes. Blasts were made from the bottom up successively at five levels. At each blast, the open space was at least one-third the volume of the shale broken in the blast. Approximately thirty-five hundred pounds of Tovex Extra, a water gel explosive sold by DuPont, was used in each blast. The void space was determined to be 31 percent by a pressure rise test in which air was introduced into the top of the rubble at 2000 standard cubic feet per minute after sealing the retort with bulkheads within the mine and with surface valves. The pressure rise data were used to calculate the volume of the void space within the retort.

The uniformity of the permeability of the rubblized mass in the retort was determined by injecting freon gases into the top of the rubblized bed at four different locations. A different freon gas was injected at each location. Air was injected into the attic space above the rubble at two different rates. The arrival time of the tracer gases was measured. The results are presented in Table I:

TABLE I

SUMMARY OF TRACER TEST FLOW RESULTS

| | | |
|---|---|---|
| Air Flow Rate, CFM | 1800 SCFM<br>2233 ACFM | 3600 SCFM<br>4267 ACFM |
| Calc. Tracer Arrival | Rubble | Rubble |

TABLE I-continued

SUMMARY OF TRACER TEST FLOW RESULTS

| Time, Min.[1] | Injection 22.5 | Injection 12.5 |
|---|---|---|
| Mean Tracer Arrival Times[2], Min. (% of Calc.)[3] | % of Calculated | % of Calculated |
| NW Corner 5 | 20.8 (92%) | 12.0 (96%) |
| SW Corner 3 | 19.1 (85%) | 10.9 (87%) |
| NE Corner 7 | 22.3 (99%) | 11.0 (88%) |
| SE Corner 12 | 27.0 (120%) | 14.1 (112%) |
| Average | 22.3 (99%) | 12.0 (96%) |

$$\text{Estimated Sweep Efficiency} = \frac{\text{Minimum Mean Arrival Time}}{\text{Calc. Arrival Time}} \times 100 = 85\%$$

Notes:

[1]Calc. Arrival Time = $\frac{\text{Total Free Volume}}{\text{Air Flow Rate, ACFM}}$

[2]Mean Arrival Time = $\int_0^\infty tc(t)dt / \int_0^\infty c(t)dt$ c(t) is measured tracer concentration

[3]Percent of calculated arrival time is "active void"

The tracer flow tests show a high uniformity of the permeability of the rubblized mass completely across the retort. The largest deviation from the average arrival time was 21 percent. The oil production on retorting by in-situ combustion was 90 percent of the theoretically available oil in the rubble or 70 percent of the Fischer assay oil.

Similar tracer tests reported for rubblized in-situ oil shale in a reactor constructed by a prior art method that did not utilize the random free fall concept of this invention gave a 10-fold or larger variation in the arrival times and a calculated sweep efficiency of 55 percent. Sweep Efficiency Modeling of Modified In-Situ Retorts, M. L. Gregg and J. H. Campbell, 13th Oil Shale Symposium, Colorado School of Mines, April 1980.

In the embodiment illustrated in FIG. 7 of the drawings, a retort 50 is made to extend a distance "a" below the lower boundary 52 of the oil shale deposit 54. The rock mined to form that portion of the retort below 52 drops through draw points 56 and is conveyed through a drift 58 and shaft 60 to the ground surface 62. Since the rock below lower boundary 52 is not oil shale, all of the oil shale can be retorted within the retort 50. Surface retorting facilities are not required. In the retort illustrated in FIG. 7, drilling of shot holes 64 could not be accomplished from the ground surface either because of the terrain of the ground surface or other reasons. To permit the necessary pattern of shot holes, a plurality of drifts 66 extending transversely above the retort 50 and a plurality of drifts 68 extending longitudinally of the retort 50 are connected to a shaft 70. The shot holes 64 are drilled from drifts 66 and 68 for construction of the retort, as described for the embodiments illustrated in FIGS. 1 through 4. Rubblization of the shale is accomplished as described for the embodiment illustrated in FIGS. 1–4 with the exception that the uppermost explosive charges are designed to form a gable type of arched roof 72 sloping at an angle of 40° to 50° with the horizontal. A sump 74 is constructed to catch liquids produced during retorting. Retorting is accomplished by conventional means such as described for the embodiments illustrated in FIGS. 1–4.

The method of constructing an in-situ retort herein described allows substantial savings in the cost of constructing a retort. Although the amount of oil shale or underlying rock that must be removed and lifted to the ground surface to provide the open space is increased, the greatly reduced development work preparatory for constructing the retort results in savings that exceed substantially the increased costs incurred from lifting more oil shale to the surface. In the construction of the retort herein described, handling of all of the material mined to provide the open space is through a single drift at the lower end of the retort. No access to the retort is necessary during rubblization; consequently, the hazards of mining and rubblization are greatly reduced by this method. In contrast, in the processes described in U.S. Pat. No. 4,043,597 of French and U.S. Pat. No. 4,017,119 of Lewis drifts at a plurality of sublevels are employed in an effort to increase the uniformity.

The in-situ retort produced by the random free fall of pieces of oil shale into a mass of rubble is characterized by a high and uniform permeability of the rubblized mass and results in a higher percentage yield of shale oil. One of the shortcomings of rubblized retorts constructed by the methods of the prior art has been the nonuniformity of the permeability of the rubblized mass. Channeling, with resultant bypassing of a portion of the shale, has occurred during retorting of such retorts and caused decreased yields of shale oil.

The high permeability of the rubblized mass reduces the pressure drop of the gases passing through the retort during the retorting operation. The reduced pressure drop allows a lower average pressure to be maintained on the retort during the retorting operation and thereby reduces the pressure tending to force combustion products into adjacent retorts where men may be working. The reduced pressure drop has the further advantage of reducing the costs of equipment and power consumption for circulation of combustion air and retorting gases through the retort.

The cooling of the shale oil as it flows through cool rubblized shale downstream of the conversion front will increase the viscosity of the shale oil and may cause plugging of passages through the rubblized mass. The higher permeability and larger openings between the pieces of oil shale in the retort constructed in accordance with this invention greatly reduces the danger of such plugging of the rubblized mass.

I claim:

1. A method of producing shale oil from an in-situ retort in an underground oil shale deposit comprising:

(a) excavating a room in the shale deposit, said room conforming in cross section to the retort and having a volume at least as large as the minimum void space in a mass of rubblized oil shale blasted from the oil shale deposit and random free falling to fill open volume the size of the desired retort;

(b) drilling a plurality of substantially vertical shot holes through the oil shale overlying the room, said shot holes extending upwardly through the shale overlying the room at least to approximately the upper end of the desired retort;

(c) after completion of step (a), initiating rubblization of the shale by detonating an explosive charge in the shot holes near the lower end thereof to fragment oil shale overlying and adjacent the room and cause random free fall of the fragments into the room to form a random-filled rubblized mass of oil shale therein with an open space between the rubble and overlying unfragmented shale;

(d) repeating the detonation of explosive charges at successively higher levels in the shot holes to fragment the shale adjacent the open space and cause random free fall of fragments of oil shale formed by each detonation through open space onto rubblized oil shale in the room underlying the unfragmented oil shale until a random-filled rubblized in-situ retort of the desired height is formed, the time between successive detonations being adequate to allow movement of shale broken by a detonation sufficiently to avoid interference by particles of shale broken by a later or earlier detonation whereby there is random free fall of the shale particles onto the upper surface of the shale in the room;

(e) passing a retorting gas downwardly through the in-situ retort to heat oil shale in the retort and release shale oil therefrom; and (f) delivering shale oil from the in-situ retort to the surface.

2. A method as set forth in claim 1 characterized by the retorting gas being combustion products formed by injecting air into the upper end of the retort, igniting oil shale in the upper end of the retort and continuing the injection of air to cause a combustion front to move downwardly through the retort whereby combustion products from the combustion front heat oil shale in the retort and release shale oil therefrom, and collecting shale oil from the bottom of the retort for delivery to the surface.

3. A method as set forth in claim 1 characterized by the room excavated in the shale deposit having open space 25 to 35 percent of the volume of the retort.

4. A method as set forth in claim 1 characterized by the volume of the open space above the upper surface of shale in the room at the time of a detonation being at least one-third the volume of shale broken from unfragmented shale by the detonation.

5. A method as set forth in claim 1 characterized by there being a plurality of spaced-apart central shot holes substantially on the longitudinal center line of the retort, the other shot holes being located in a radial pattern around the central shot holes, and the detonation of the explosive charges at each level being initially in the central shot holes and proceeding successively radially outward from the central shot holes.

6. A method as set forth in claim 1 characterized by the shot holes extending upwardly to the ground surface.

7. A method as set forth in claim 1 characterized by the retort having a length in the range of 60 to 400 feet and a width of 30 to 150 feet, and the shot holes being located to break unfragmented shale substantially uniformly over the length and width of the retort on detonation of the explosive charges.

8. A method as set forth in claim 1 characterized by the placement of explosives being adapted to form a retort with an arched roof in which the roof at the intersection with the walls of the retort slopes upwardly at an angle of at least 45 degrees.

9. A method as set forth in claim 8 in which the rubblized oil shale does not completely fill the retort thereby leaving an attic at the top of the retort.

10. A method as set forth in claim 6 characterized by enlarging at least some of the shot holes above the retort, and delivering air through the enlarged shot holes for retorting of the oil shale.

11. A method as set forth in claim 1 characterized by contructing a drift extending longitudinally of and above the retort, constructing a drilling drift extending transversely of the retort and above the retort at a different elevation than the drilling drift extending longitudinally of the retort, the drilling drifts being spaced above the upper end of the retort and separated therefrom by a sill, and drilling the shot holes downardly from the drilling drifts into the retort.

12. A method as set forth in claim 1 characterized by extending the retort into basement rock below the oil shale, the room being excavated at least in part in the basement rock, and the excavated basement rock being lifted to the surface.

13. A method as set forth in claim 1 characterized by the time between the detonation of explosives at one level and the detonation of explosives at the next level being at least 50 milliseconds.

14. A method as set forth in claim 5 characterized by the time between detonations of explosive charges and the next explosive charges radially outward therefrom at the same level being 5 to 100 milliseconds.

15. An in-situ retort for the retorting of oil shale in an underground oil shale deposit to produce shale oil comprising an underground cavity in the oil shale containing random-filled oil shale rubble of high and uniformly distributing void space, formed by creating a room in the lower end of the retort having a volume at least as large as the minimum void space in a mass of random free fall rubblized oil shale of the volume of the retort and not less than 25 percent of the volume of the retort, drilling substantially vertical shot holes extending through the oil shale overlying the room, and detonating explosive charges in the shot holes to initiate and cause random free fall of the oil shale fragments into the room to form the random-filled rubblized mass of oil shale substantially filling the retort.

16. A retort as set forth in claim 15 characterized by an arched roof having an upward slope of at least 45 degrees at the intersection with the side walls of the retort.

17. A retort as set forth in claim 16 characterized by the upper boundary of the rubblized shale being below the top of the arched roof whereby an open attic extends along the top of the retort.

18. A method as set forth in claim 1 characterized by the open space under the unfragmented shale at each blast being at least twenty-five percent of the volume of shale broken by the blast.

* * * * *

UNITED STATES PATENT OFFICE
CERTIFICATE OF CORRECTION

Patent No. 4,378,949 Dated April 5, 1983

Inventor(s) J. Blaine Miller

It is certified that error appears in the above-identified patent and that said Letters Patent are hereby corrected as shown below:

Col. 6, line 5 - after "desired" insert:

--If the void space in the rubblized shale is to be 30 percent,--

Claim 15, Col. 12, line 34, "distributing" should be --distributed--

Signed and Sealed this

*Twenty-second* Day of *May 1984*

[SEAL]

*Attest:*

GERALD J. MOSSINGHOFF

*Attesting Officer* *Commissioner of Patents and Trademarks*